US006853278B2

(12) United States Patent
Baldauf et al.

(10) Patent No.: US 6,853,278 B2
(45) Date of Patent: Feb. 8, 2005

(54) TRIPPING DEVICE

(75) Inventors: Josef Baldauf, Lappersdorf (DE); Gerald Nörl, Burglengenfeld (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/111,548

(22) PCT Filed: Feb. 23, 2001

(86) PCT No.: PCT/EP01/02090

§ 371 (c)(1),
(2), (4) Date: Apr. 26, 2002

(87) PCT Pub. No.: WO01/65583

PCT Pub. Date: Sep. 7, 2001

(65) Prior Publication Data

US 2002/0153238 A1 Oct. 24, 2002

(30) Foreign Application Priority Data

Mar. 1, 2000 (EP) ..... 00104266

(51) Int. Cl.[7] ..... H01H 9/00
(52) U.S. Cl. ..... 335/172
(58) Field of Search ..... 335/23–25, 165–176, 335/185–195

(56) References Cited

U.S. PATENT DOCUMENTS

| | | | | |
|---|---|---|---|---|
| 3,257,523 A | | 6/1966 | Clarke | |
| 4,794,356 A | * | 12/1988 | Yu et al. | 335/13 |
| 4,894,631 A | * | 1/1990 | Castonguay et al. | 335/167 |
| 5,343,179 A | * | 8/1994 | Pipich et al. | 335/167 |
| 5,793,026 A | * | 8/1998 | Kolberg et al. | 335/172 |

FOREIGN PATENT DOCUMENTS

| | | |
|---|---|---|
| EP | 0 357 472 A1 | 3/1990 |
| FR | 2 671 907 A1 | 7/1992 |

* cited by examiner

*Primary Examiner*—Lincoln Donovan
*Assistant Examiner*—Bernard Rojas
(74) *Attorney, Agent, or Firm*—Harness, Dickey & Pierce, P.L.C.

(57) ABSTRACT

A tripping device used for protective circuit breakers. In the event that tripping is required, a detection unit drives a tripping element which is able to engage with the latching part of a protective circuit-breaker device. The tripping element is positioned and mounted in such a way that it is interchangeable and can be replaced with differently shaped tripping elements.

29 Claims, 5 Drawing Sheets

TRIPPING DEVICE

This application is the national phase under 35 U.S.C. § 371 of PCT International Application No. PCT/EP01/02090, which has an International filing date of Feb. 23, 2001, which designated the United States of America, the entire contents of which are hereby incorporated by reference.

FIELD OF THE INVENTION

The invention generally relates to a tripping device for protective switching devices. In particular, it may relate to one in which, for the tripping situation, a detection unit drives a tripping element which can engage on the latching point of a protective switching device.

BACKGROUND OF THE INVENTION

Tripping devices such as these are generally in the form of so-called holding magnet releases for fault current circuit breakers which operate independently of the power supply system voltage and for differential current protective devices which operate as a function of the power supply system voltage. Electromechanical tripping devices which have an electrodynamic overvoltage release and a thermal overcurrent release for long-term overloading are provided for tripping circuit breakers, for example miniature circuit breakers.

A tripping device such as this generally operates via a tripping element on a latching point of a switching mechanism as a force store, which then opens switching contacts in a line to be protected. There are also a wide range of other embodiments of tripping devices.

According to normal practice, each application requires its own specifically designed tripping device.

SUMMARY OF THE INVENTION

An object of an embodiment of the invention is based on developing a tripping device which can be matched to the most widely differing types of individual applications.

According to an embodiment of the invention, the described object can be achieved by a tripping device. In this case, the tripping element may be arranged and mounted such that it is interchangeable, and can be replaced by differently shaped tripping elements.

At least during the assembly process, the tripping device can thus be matched to the application via a tripping element provided for that respective application. The tripping element may be designed to be hook-shaped in the form of a tripping plunger, which is mounted at its end facing a tripping kinematic arrangement. At its other end, the engagement end, the plunger can be matched to the engagement conditions of a protective switching device. In this case, the most widely differing types of hook shapes can be provided, and one engagement end of the actual plunger can form lever arms of different length from the rotation point, and the plunger may also be designed to have a different length. This makes it possible to satisfy a wide range of applications.

The tripping plunger can also be designed for a linear engagement movement. This makes it possible to satisfy other applications.

The tripping plunger can be connected to a drive element which can be coupled to different types of drive plungers. This makes it easier to replace the tripping plunger.

The tripping plunger can be mounted on the housing of the tripping mechanism, or on a mounting plate.

The tripping element may also be in the form of a rotating shaft, and may act on switching devices to be fitted at the sides.

The tripping device may have a tripping mechanism arranged in the form of a cuboid, with the tripping plunger being arranged on a narrow end face. In the case of a tripping mechanism in the form of a cuboid, the tripping plunger can also be arranged on a narrow face. The more advantageous configuration depends on the intended modular construction of the protective switching device and tripping device. The tripping mechanism may be arranged in a sealed housing, thus protecting it against dust, moisture and hazardous gases. Such a tripping device may advantageously be used in the most widely differing types of modular overall arrangements.

BRIEF DESCRIPTION OF THE DRAWINGS

The invention will now be explained in more detail with reference to the exemplary embodiments, which are shown roughly schematically in the drawings, in which.

DETAILED DESCRIPTION OF THE PREFERRED EMBODIMENTS

Figure 1:
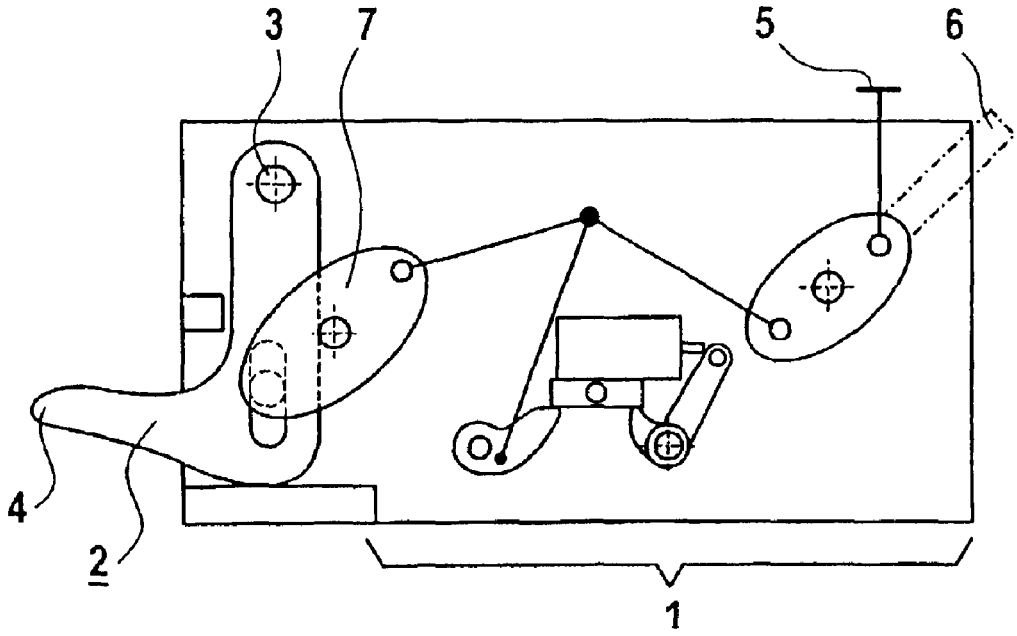
FIG. 1 shows a tripping device with a tripping element.
Figure 2:
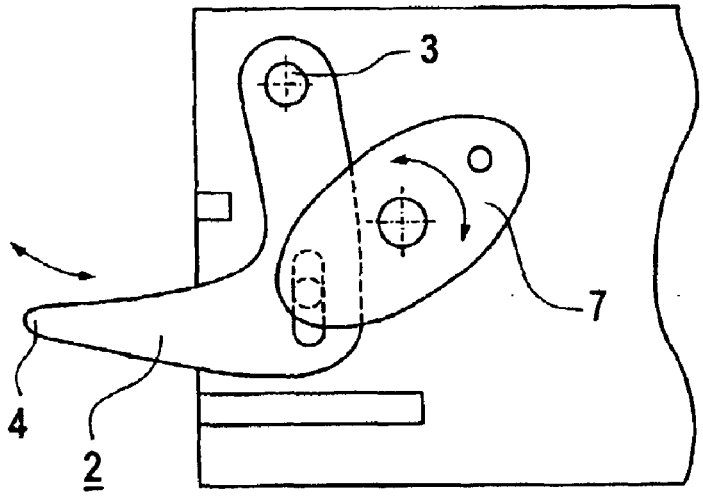
FIG. 2 shows, for a device as shown in FIG. 1, a different tripping element with a drive element as shown in FIG. 1.
Figure 3:
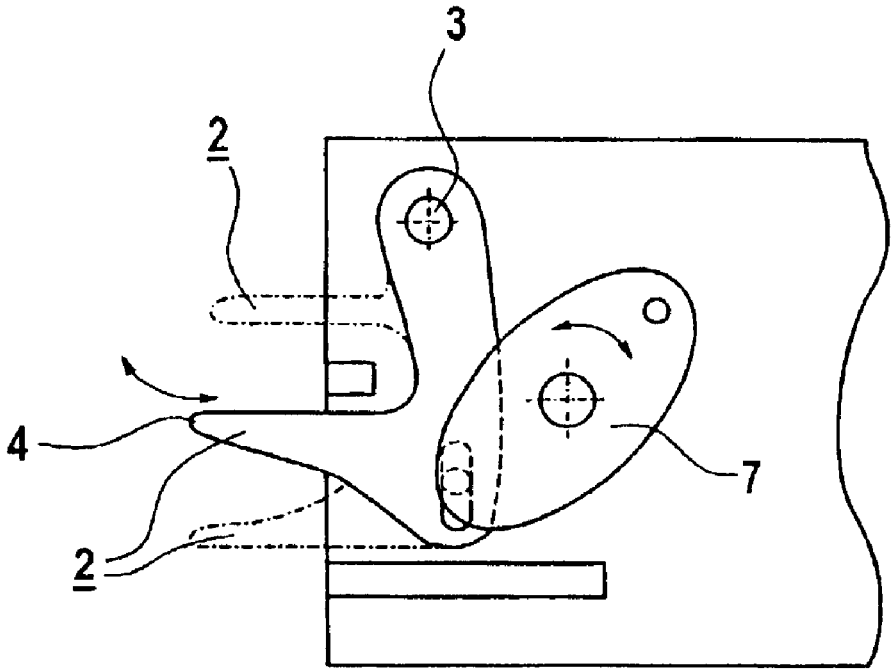
FIG. 3 shows how tripping elements of different configurations can be used instead of the tripping elements as shown in FIG. 2. The shapes illustrated may be used as alternatives.

The tripping device shown in FIG. 1 can be fitted to a protective switching device. It has a detection unit 1 for a tripping situation and a tripping device 2, via which it can engage on the latching point of a protective switching device. The tripping element is arranged interchangeably, and is mounted in a bearing point 3. It can be replaced by differently shaped tripping elements. In the exemplary embodiment shown in FIG. 1, the tripping element is designed in the form of a hook as a tripping plunger, which is mounted at its end facing a tripping kinematic arrangement. At its other end, the engagement end 4, the tripping element is matched by selection to the engagement conditions of a protective switching device. In the exemplary embodiment, the tripping device is designed with a reconnection button 5 as shown in FIG. 1 or with a reconnection lever 6 as shown in FIG. 1, which should be regarded as alternatives. The tripping device can also be designed for automatic reconnection.

In FIGS. 1 to 4, the plunger-type tripping element 2 is connected to a drive element 7, which can be coupled to different types of tripping plungers.

Figure 4:
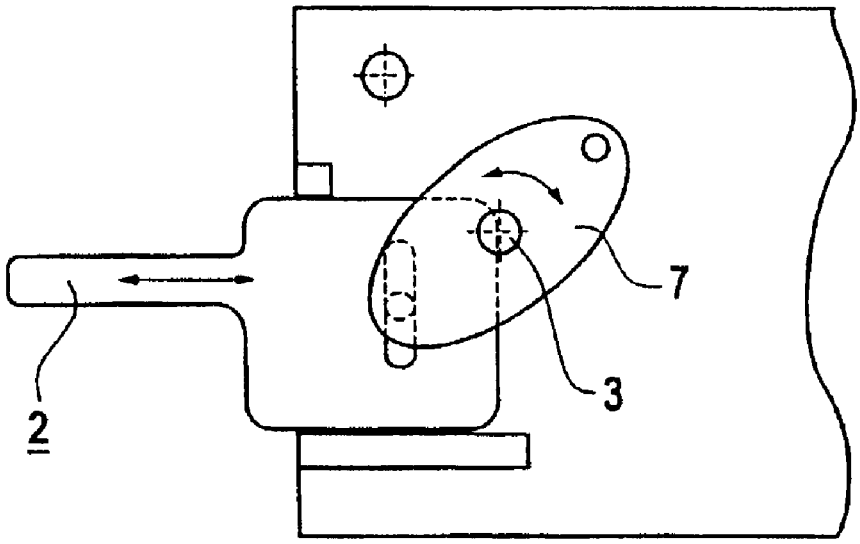
FIG. 4 shows a tripping element with a linear engagement movement.

In the tripping device shown in FIG. 4, the tripping element 2 is in the form of a tripping plunger for a linear engagement movement.

Figure 5:
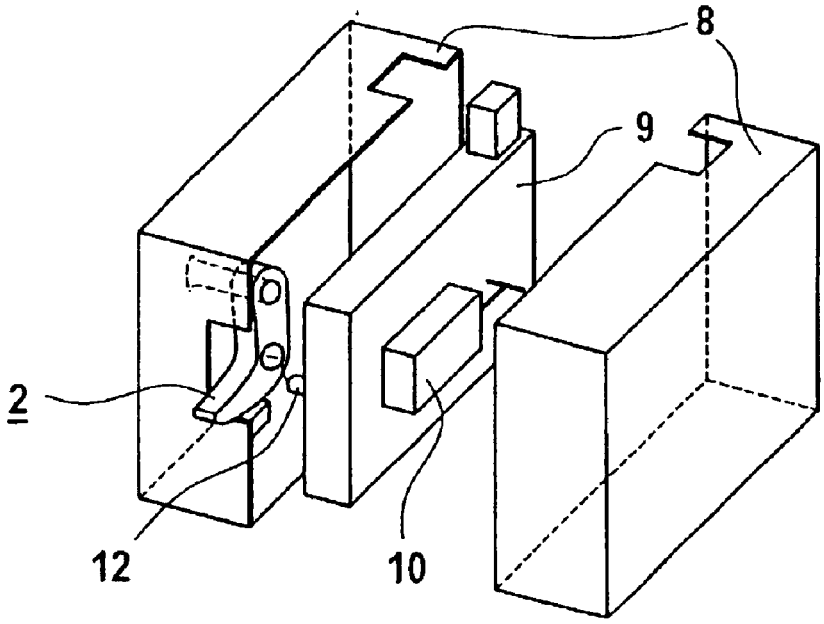
FIG. 5 shows an exemplary embodiment of the overall design of a tripping device as shown in FIG. 1, illustrated in perspective.

The tripping element 2 as shown in FIG. 5 may be in the form of a plunger, and may be mounted on housing parts 8 of the tripping device. In the exemplary embodiment shown in FIG. 5, a force storage mechanism 9 is provided, in the sense of a force amplifier. An electromagnetic release 10 is fitted to the force storage mechanism 9, at the side.

Figure 6:
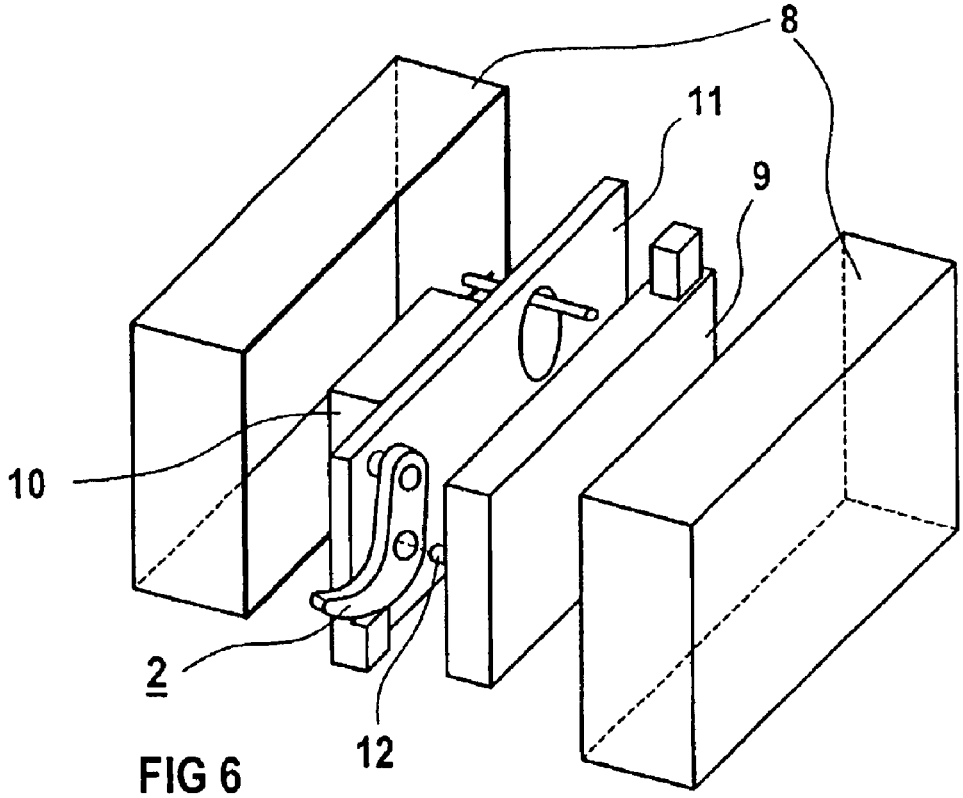
FIG. 6 shows another overall design of the tripping device shown in FIG. 1, illustrated in perspective.

In the exemplary embodiment shown in FIG. 6, the tripping element 2 is mounted in the form of a tripping plunger on a mounting plate 11. In the exemplary embodiment shown in FIGS. 5 and 6, the force storage mechanism 9 acts on the tripping element 2 via a drive element 12.

Figure 7:
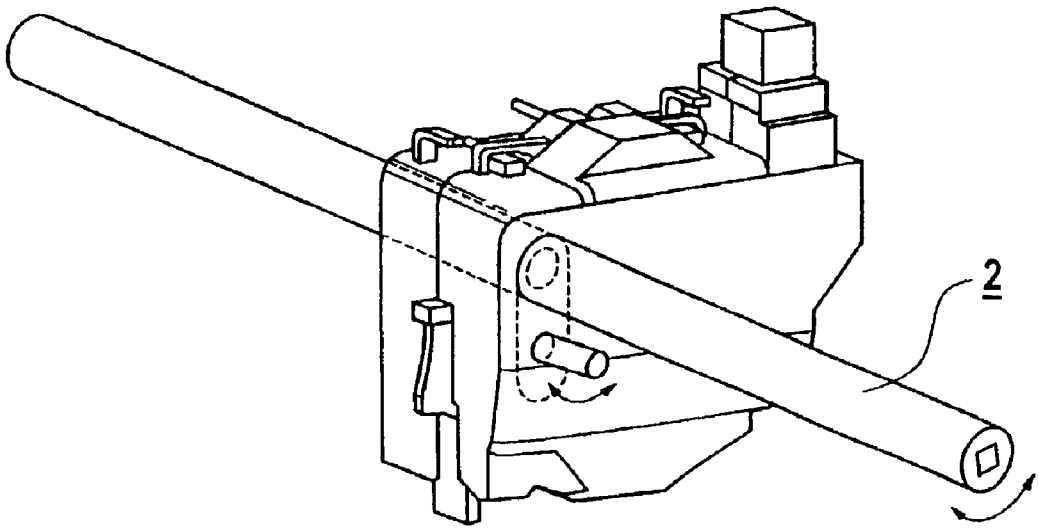
FIG. 7 shows a tripping device with a tripping element in the form of a rotating shaft, illustrated in perspective.

The tripping element 2 may also be in the form of a rotating shaft, as is shown in FIG. 7.

Figure 8:
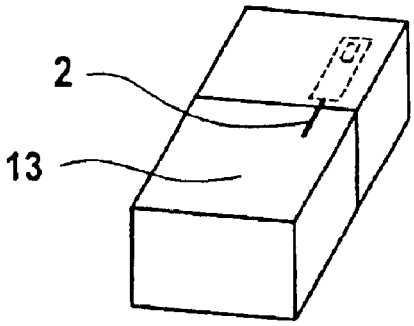
FIG. 8 shows a first embodiment of the assembly of the tripping device with a protective switching device.
Figure 9:
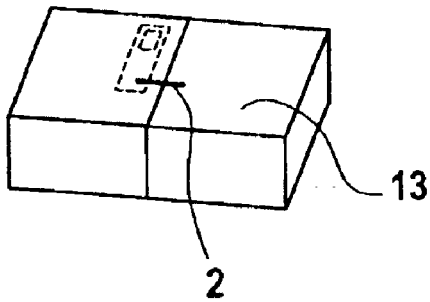
FIG. 9 shows another exemplary embodiment of the assembly of the tripping device with a protective switching device, illustrated in perspective.

As shown in FIGS. 8 and 9, the tripping device may be provided with a tripping mechanism in the form of a cuboid, whose tripping element 2, which is in the form of a tripping plunger, can act on an add-on unit 13, for example a circuit breaker. As shown in FIG. 8, the tripping element 2 in the form of a tripping plunger is arranged on a narrow end face of the tripping mechanism. In the embodiment shown in FIG. 9, the tripping element 2 is arranged in the form of a tripping plunger on a narrow face. It is thus possible to match the most widely differing types of fittings.

Figure 10:
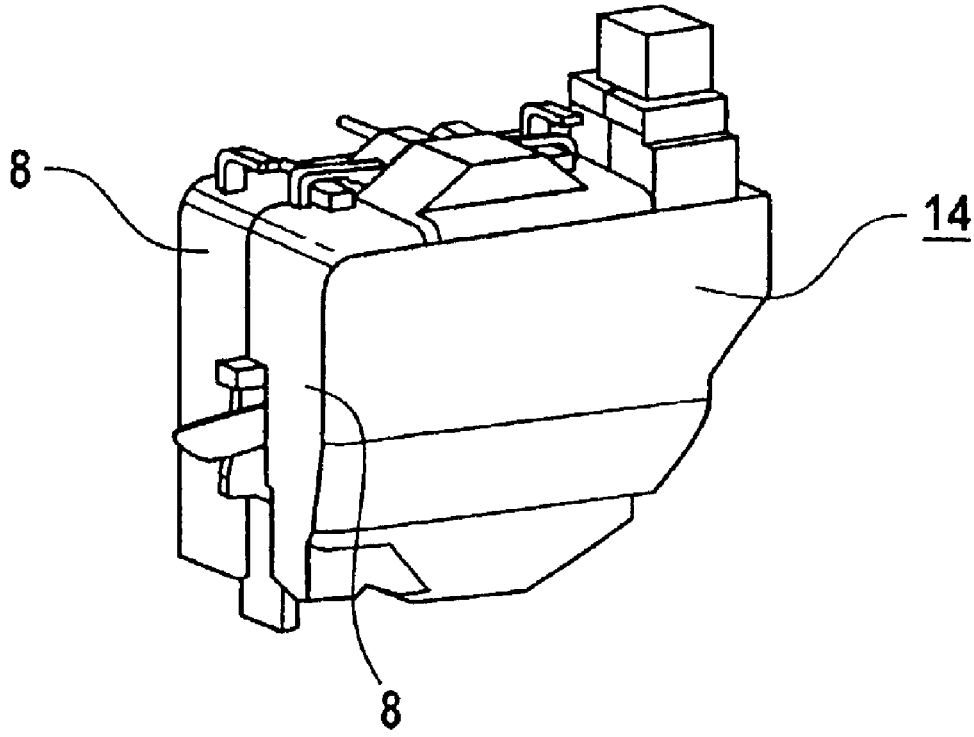
FIG. 10 shows a tripping device with a sealed housing, illustrated in perspective.

The tripping device can be accommodated with its tripping mechanism in a sealed housing 14 with the housing parts 8 shown in FIG. 10.

The tripping device may operate electromagnetically, or may be designed in an electronic form.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. A tripping device for a protective switching device, comprising:

a tripping element, adapted to engage on a latching point of the protective switching device; and a detection unit, adapted to drive the tripping element when tripping is required, wherein the protective switching device is arranged to receive and mount each of a plurality of differently shaped interchangeable tripping elements.

2. The tripping device as claimed in claim 1, wherein the tripping element is hook-shaped, including a bearing point at an end facing a tripping kinematic arrangement and at an engagement end, is matched to the engagement conditions of the protective switching device.

3. The tripping device as claimed in claim 2, wherein the tripping element is a tripping plunger for a linear engagement movement.

4. The tripping device as claimed in claim 1, wherein the tripping element is connectable, as a tripping plunger, to a drive element, which is coupleable to a different type of tripping plunger.

5. The tripping device as claimed in claim 1, wherein the tripping element is mounted in the form of a tripping lever on the housing of the tripping mechanism.

6. The tripping device as claimed in claim 1, wherein the tripping element is mounted, in the form of a tripping lever, on a mounting plate.

7. The tripping device as claimed in claim 1, wherein the tripping element is a rotating shaft.

8. The tripping device as claimed in claim 1, wherein a tripping mechanism is cuboid in shape, and the tripping element is arranged, in the form of a tripping plunger, on a narrow end face thereof.

9. The tripping device as claimed in claim 1, wherein a tripping mechanism is cuboid in shape, and the tripping element is arranged, in the form of a tripping plunger, on a narrow face thereof.

10. The tripping device as claimed in claim 1, wherein the tripping mechanism is arranged in a sealed housing.

11. The tripping device as claimed in claim 2, wherein the tripping clement is connectable, as a tripping plunger, to a drive element, which is coupleable to a different type of tripping plunger.

12. The tripping device as claimed in claim 3, wherein the tripping element is connectable, as a tripping plunger, to a drive element, which is coupleable to a different type of tripping plunger.

13. The tripping device as claimed in claim 2, wherein the tripping element is mounted in the form of a tripping lever on the housing of the tripping mechanism.

14. The tripping device as claimed in claim 2, wherein the tripping element is mounted, in the form of a tripping lever, on a mounting plate.

15. The tripping device as claimed in claim 2, wherein the tripping element is a rotating shaft.

16. The tripping device as claimed in claim 2, wherein a tripping mechanism is cuboid in shape, and the tripping element is arranged, in the form of a tripping plunger, on a narrow end face thereof.

17. The tripping device as claimed in claim 2, wherein a tripping mechanism is cuboid in shape, and the tripping element is arranged, in the form of a tripping plunger, on a narrow face thereof.

18. The tripping device as claimed in claim 1, wherein the tripping mechanism is arranged in a sealed housing.

19. The tripping device of claim 1, wherein the protective switching device is a circuit breaker.

20. A protective switching device, comprising:

a tripping device, the tripping device including, a tripping element, adapted to engage on a latching point of the protective switching device, and a detection unit, adapted to drive the tripping element when tripping is required, wherein the protective switching device is arranged to receive and mount each of a plurality of differently shaped interchangeable tripping elements.

21. The protective switching device of claim 20, wherein the protective switching device is a circuit breaker.

22. The protective switching device as claimed in claim 20, wherein the tripping element is hook-shaped, including a bearing point at an end facing a tripping kinematic arrangement and at-an engagement end, is matched to the engagement conditions of the protective switching device.

23. The protective switching device as claimed in claim 22, wherein the tripping element is a tripping plunger for a linear engagement movement.

24. The protective switching device as claimed in claim 20, wherein the tripping element is connectable, as a tripping plunger, to a drive element, which is coupleable to a different type of tripping plunger.

25. The protective switching device as claimed in claim 20, wherein the tripping element is mounted in the form of a tripping lever on the housing of the tripping mechanism.

26. The protective switching device as claimed in claim 20, wherein the tripping element is mounted, in the form of a tripping lever, on a mounting plate.

27. The protective switching device as claimed in claim 20, wherein the tripping element is a rotating shaft.

28. The protective switching device as claimed in claim 20, wherein a tripping mechanism is cuboid in shape, and the tripping element is arranged, in the form of a tripping plunger, on a narrow end face thereof.

29. The protective switching device as claimed in claim 20, wherein a tripping mechanism is cuboid in shape, and the tripping element is arranged, in the form of a tripping plunger, on a narrow face thereof.

* * * * *